United States Patent [19]

Postler et al.

[11] 4,138,946

[45] Feb. 13, 1979

[54] IGNITION VOLTAGE GENERATOR FOR PROJECTILE DETONATORS AND THE LIKE

[75] Inventors: Günter Postler, Röthenbach; Wilhelm Fürst, Buchberg; Norbert Liebl, Röthenbach; Werner Rudenauer, Roth, all of Fed. Rep. of Germany

[73] Assignee: Diehl GmbH & Co., Nüremberg, Fed. Rep. of Germany

[21] Appl. No.: 866,540

[22] Filed: Jan. 3, 1978

[30] Foreign Application Priority Data

Jan. 26, 1977 [DE] Fed. Rep. of Germany ... 7702073[U]

[51] Int. Cl.[2] ..... F42C 11/02

[52] U.S. Cl. ..... 102/210

[58] Field of Search ..... 102/210

[56] References Cited

U.S. PATENT DOCUMENTS 3,738,275 6/1973 Schwartz et al. ..... 102/210

*Primary Examiner*—Charles T. Jordan

*Attorney, Agent, or Firm*—Scully, Scott, Murphy & Presser

[57] ABSTRACT

An ignition or firing voltage generator adapted to be actuated only proximate the peak of an inertial force and, in its equilibrium position will not emit a voltage even when subjected to hard shocks. A piezoceramic cell, as well as a solid body which is arranged axially adjacent thereto, are located within a preferably cylindrical support member which is axially displaceably guided within a tubularly-shaped component of an igniter housing, but in the initial position thereof is so restrained through the utilization of a securing element in the configuration of a shear element, spring fastener or the like, that its base is located at a defined spacing opposite a base plate of the igniter or detonator housing. A securing element of that type, without difficulty, may be so dimensioned that it will only first release the support member, when it is influenced by approximately the maximum inertial force. The base of the support member facing towards the base plate of the igniter housing, and/or the base plate of the igniter housing facing towards the base of the support member, may be slightly cambered or curved. A short-circuiting bridge which, in the initial position of the voltage generator, connects the two voltage poles of the piezoceramic cell and, in response to the axial displacement of the support member, will rupture at a notched location, so that in the equilibrium position, voltages generated in the cell through shock or vibration cannot lead to a faulty or unintended powering of the igniter or detonator fuse.

15 Claims, 6 Drawing Figures

IGNITION VOLTAGE GENERATOR FOR PROJECTILE DETONATORS AND THE LIKE

BACKGROUND OF THE INVENTION

1. Field of the Invention

The present invention relates to a firing voltage generator for a projectile detonator or fuse and the like, which evidences a piezoceramic cell as the firing voltage source wherein, upon the exceeding of a minimum acceleration during the projectile firing sequence, an ignition or firing voltage is producible through the effect of the inertial force of a solid body.

2. Discussion of the Prior Art

In firing voltage generators of the mentioned type, which include a piezoceramic cell as the firing voltage source, the voltage of which is generated through the intermediary of pressure or impact of a bulky or solid body, generally has the magnitude of the voltage dependent upon the maximum moment of force. Consequently, it is of importance that the inertial force which emanates during the firing phase is allowed to only become effective when it just about reaches its peak and then, if possible to instantaneously come into effect. In order to achieve the foregoing, a securing element is utilized in a known manner, for instance, a shear element or the like, which will maintain the solid body in its equilibrium position raised a predetermined distance from the piezoceramic cell.

By means of the heretofore known configuration of the firing voltage generator it has not always been able to provide assurance that the solid body will fully contact the cell upon impact therewith and that there will be achieved a maximum degree of conversion of the impact energy into electrical energy. Thus, for example, it is possible that the solid body will tilt so that the impact, respectively the shock wave, only partially traverses the piezoceramic cell. In the extreme case, it is even possible to damage the piezoceramic cell.

SUMMARY OF THE INVENTION

Accordingly, it is an object of the present invention to eliminate the foregoing drawbacks encountered in the prior art by producing an arrangement which provides that the firing voltage generator is actuated only proximate the peak of the inertial force and, in its equilibrium position will not emit a voltage even when subjected to hard shocks.

In order to attain the foregoing object, the piezoceramic cell, as well as a solid body which is arranged axially adjacent thereto, are located within a preferably cylindrical support member which is axially displaceably guided within a tubularly-shaped component of the igniter housing, but in the initial position thereof is so restrained through the utilization of a securing element in the configuration of a shear element, spring fastener or the like, that its base is located at a defined spacing opposite a base plate of the igniter or detonator housing. A securing element of that type, without difficulty, may be so dimensioned that it will only first release the support member, when it is influenced by approximately the maximum inertial force.

A further object of the present invention lies in that the ignition voltage generator is so constructed so as to produce an optimum transmission of the shock wave from the solid body to the ceramic cell.

For this purpose, in accordance with a further feature of the invention, the base of the support member facing towards the base plate of the igniter housing, and/or the base plate of the igniter housing facing towards the base of the support member, may be slightly cambered or spherically curved. An eventually occurring light inclination of the support member during its axial displacement and the thereby resultant consequences of unequal subjecting of the cell by impact energy are thereby prevented.

Through the application of a short-circuiting bridge which, in the initial position of the firing generator, connects the two voltage poles of the piezoceramic cell and in response to the axial displacement of the support member will rupture at a notched location, there is achieved that, in the equilibrium position, voltages generated in the cell by shock or vibration cannot lead to a faulty powering of the igniter or detonator fuse.

BRIEF DESCRIPTION OF THE DRAWINGS

Further features and advantages of the invention, as well as constructional details thereof, can now be readily ascertained from the following description of an exemplary embodiment thereof, taken in conjunction with the accompanying drawings; in which.

DETAILED DESCRIPTION

Figure 1:
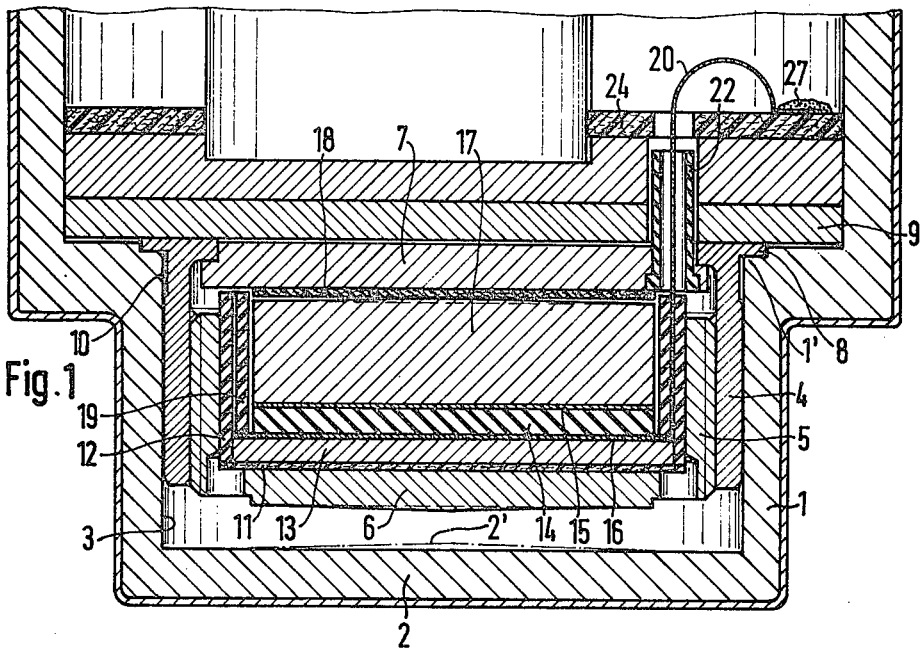
FIG. 1 illustrates a transverse sectional view of a firing or igniting voltage generator constructed in accordance with the present invention.

In accordance with the illustration of FIG. 1 of the drawings, an igniter housing 1 evidences a thickened base plate 2 which is constructed as an impact surface which, as desired, is provided towards the interior thereof with an upward curvature or camber 2'. Arranged in a cylindrical portion 3 of the igniter housing 1 is a tubularly-shaped support member or holder 4, whose upper end is widened inwardly in a ring-shaped configuration and which retains a cover plate 7. A radially outwardly projecting rim 8 serves as a shear element which, without play, is axially clamped between a shoulder 1' of the igniter housing 1 and a plate 9. Below the shear element 8, the support member 4 is provided with a radial recess 10. The thickness of the shear element 8, in conjunction with the configuration of the recess and its depth determines the actual shear location, as well as the required shearing force. A blank or cup 5 is threaded into the support member 4 from below thereof, and evidences a thickened downwardly curved or cambered bottom 6. When the base plate 2 is curvedly shaped, then the bottom surface of the cup bottom 6 can be planar while, reversely, the upper surface of the base plate 2 can be planar when the bottom 6 of the cup 5 is shaped to be downwardly curved.

Located within the cup 5 is an impact plate 13 which is separated from the bottom 6 by an insulating material disc 11 and outwardly thereof encompassed by an insulating material tube 12, a piezoceramic cell 14 and a bulky or solid body 17. The piezoceramic cell 14 is coated on both sides thereof with, respectively, a conductive layer 15, 16. The cell 14 and the solid body 17 lying thereon are surrounded by a further insulating material tube 19. Another insulating material disc 18 separates the preferably upwardly curved or, respectively with a comparable insert provided, solid body 17 from the cover plate 7.

From the conductive layer 16 a conductor loop 20 leads upwardly through an insulating material tube 22 to the igniter or detonator and is there fastened to a point of attachment 27 on an insulating material plate 24 of the igniter. A second conductor loop 21 (FIG. 2) leads, in an analogous manner, from the opposite pole of the piezoceramic cell 14, meaning from the conductive layer 15 through insulating material tube 23 (FIG. 2) to a further point of attachment on the insulating material plate 24. As illustrated in FIG. 1, the two conductive loops 20, 21, are so long that, in response to an axial displacement of the support member 4 towards the base 2, neither comes into contact with a conductive portion of the igniter, nor will they rupture; in essence, they form a follower loop.

Figure 3A:
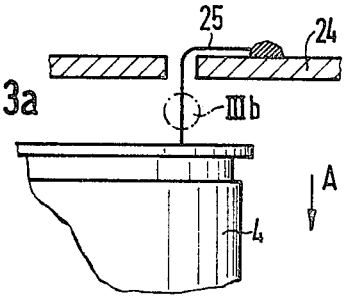
FIG. 3*a* is a sectional detail view of the firing voltage generator of FIG. 1.

However, in addition to these conductor loops 20, 21, in accordance with FIG. 3*a*, there can also be provided a further conductor 25 in the firing voltage generator, leading, for example, from conductive layer 16 to the point of the attachment to the opposite pole, meaning, to the conductor loop 21 which leads to the conductive layer 15. Thus, this conductor 25 represents a short-circuiting bridge. However, in contrast with the conductor loops 20, 21, this conductor 25 is measured so short that it ruptures upon an axial displacement of the support member 4 into an impact position. This has the consequence that during the aforementioned axial displacement, namely, immediately preceding the impact of the bottom 6 against the base plate 2, there is removed the short-circuit between the two voltage poles, meaning, the conductive layers 15, 16. In order to facilitate the rupturing of the conductor 25, according to FIG. 3*b*, the conductor 25 is provided with a constriction, respectively, a notch 26 which serves as a reference or actual rupture location.

Figure 2:
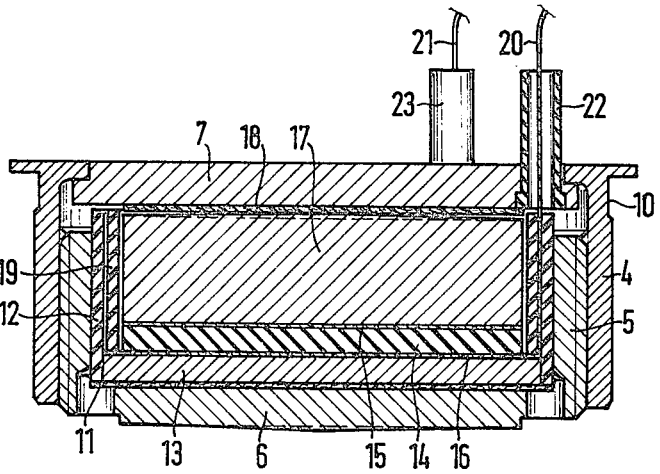
FIG. 2 is a sectional view of the displaceable portion of the ignition voltage generator of FIG. 1.

As can be ascertained from FIGS. 1 and 2, the holder or support member 4, besides the cup 5, 6 and the abovementioned inserts 13, 14, 17 inclusively of the cover plate 7, represents a self-closed unit, which can be preassembled externally of the igniter and tested with respect to operability and polarity.

Figure 3B:
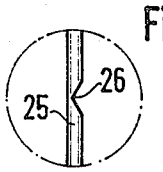
FIG. 3*b* is an enlarged sectional fragmentary detail of area III*b* encircled in FIG. 3*a;*
Figure 4:
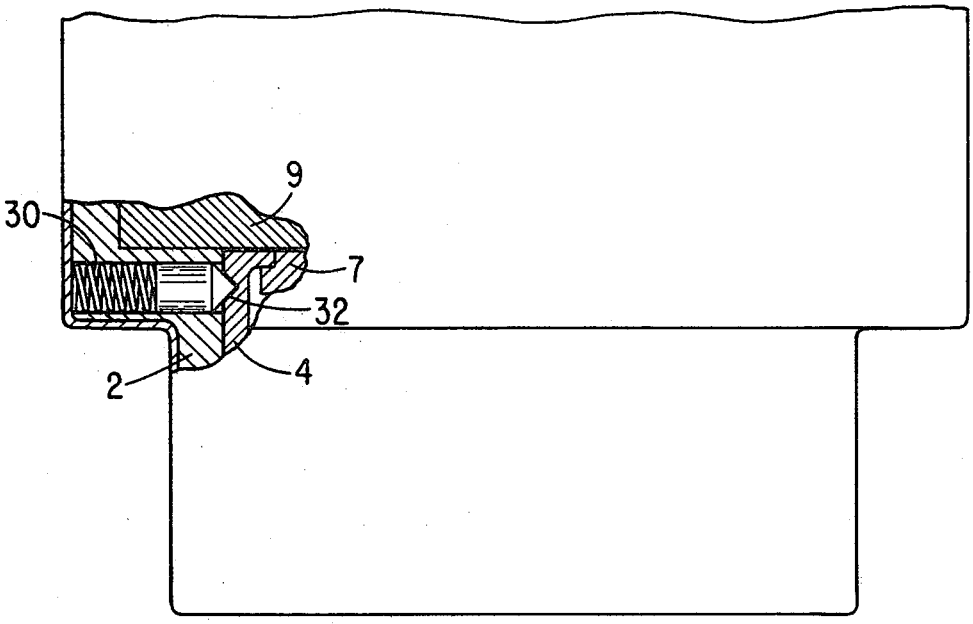
FIG. 4 is a sectional view of a spring lock securing device in the ignition voltage generator.
Figure 5:
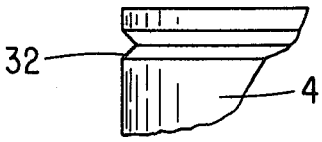
FIG. 5 is a fragmentary detail of a groove arrangement adapted to be engaged by the lock securing device.

Subsequent to being built-in within the lower, tubularly-shaped portion of the igniter housing 1, the abovementioned unit is clamped in without play through intermediary of the shear element 8. Naturally, in lieu of a shear element there can also be employed a spring lock securing device 30 which is releasably engageable in an annular groove 32 formed in the support member 4, as shown in FIGS. 4 and 5 of the drawings, or another corresponding securing element which becomes releasable only at a minimum axial load. In the initial position, the voltage poles of the piezoceramic cell 14 are bridged by means of the short-circuiting bridge as represented in FIGS. 3*a* and 3*b* (conductor 25). Through shocks received during transport, vibration or the like, voltages generated in the cell 14 can thus not lead to an erroneous supply of power to the igniter. When, upon firing of the projectile, a preselected threshold value is exceeded, in essence, by means of the dimensioning of the securing element (shear element 8), then the inertial force which is produced by the acceleration of the projectile overcomes the locking action of the securing element. The support member 4, besides the ignition or firing voltage generator which is constituted of the abovementioned components, is then rearwardly displaced (downwardly). Thereby this causes the short-circuiting bridge (conductor 25) to immediately rupture. Thereafter the cup bottom 6 impacts centrally against the base plate 2, respectively 2', of the igniter housing 1. By means of the sudden or instantaneous braking the piezoceramic cell 14 is subjected to a high, impulse-like pressure loading by the solid body 17, which leads to a corresponding voltage output at the conductor loops 20, 21.

While the sudden braking leads to a correspondingly steep increase in the loading and, consequently, in the voltage, through the cambered or curvilinear configuration of the cup bottom 6, respectively, the base plate 2, 2' in the igniter housing 1, there is afforded that the shock wave will traverse the piezoceramic cell 14 even upon tilting of the receptacle body 4 upon impact so that, on the one hand, there is provided no differing but, in all instances, a nearly maximum uniformly level energy output and, on the other hand, there are avoided damages caused by fractures.

What is claimed is:

1. In an ignition or firing voltage generator for projectile detonators and the like; including a piezoceramic cell forming an ignition voltage source for an igniter; and a solid body adapted to have the inertial force thereof influence said cell to generate an ignition voltage upon exceeding of a minimum acceleration during the firing sequence of a projectile, the improvement comprising: a generally cylindrical support member, said piezoceramic cell and said solid body being arranged within said support member; an igniter housing having a tubularly-shaped portion, said support member being axially displaceably supported in said tubular portion; and securing means restraining said support member whereby the bottom of the former is arranged at a predetermined distance from a base plate of said igniter housing.

2. A voltage generator as claimed in claim 1, said securing means comprising a shear element.

3. A voltage generator as claimed in claim 1, said securing means comprising a spring lock.

4. A voltage generator as claimed in claim 1, said bottom in said support member having a curvilinear surface facing towards said base plate of said igniter housing.

5. A voltage generator as claimed in claim 1, said base plate of said igniter housing having a curvilinear surface facing towards said bottom in said support member.

6. A voltage generator as claimed in claim 1, said bottom in said support member having a curvilinear surface facing towards said base plate of said igniter housing, and said base plate of said igniter housing having a curvilinear surface facing towards said bottom in said support member.

7. A voltage generator as claimed in claim 1, said support member including cover plate means proximate a surface of said solid body, said surface being curvilinearly-shaped towards said cover plate means.

8. A voltage generator as claimed in claim 1, said support member including cover plate means proximate a surface of said solid body; and insert means having at least one curvilinear surface being interposed between said cover plate means and said solid body surface.

9. A voltage generator as claimed in claim 2, said shear element comprising a projecting edge portion of said support member, said edge portion being clamped without play into said igniter housing.

10. A voltage generator as claimed in claim 9, comprising a radially extending recess being formed in said support member below said shear element.

11. A voltage generator as claimed in claim 1, said piezoceramic cell including two voltage poles; and conductors extending through insulating tubes for connecting the two voltage poles of said piezoceramic cell to said igniter.

12. A voltage generator as claimed in claim 11, comprising a further conductor for short-circuiting said voltage poles in the initial position of said support member and adapted to be ruptured responsive to displacement of said support member into an impact position.

13. A voltage generator as claimed in claim 12, said short-circuiting conductor forming a short-circuiting bridge having a constriction therein to facilitate rupturing thereof.

14. A voltage generator as claimed in claim 13, said constriction comprising a notch formed in said short-circuiting bridge.

15. A voltage generator as claimed in claim 11, said support member, piezoceramic cell, solid body, cover plate means and conductors forming a self-closed preassembled unitary structure adapted to be tested for operability and correct poling through the application of axial pressure loading.

* * * * *